US005849184A

United States Patent [19]

Veillet

[11] Patent Number: 5,849,184

[45] Date of Patent: Dec. 15, 1998

[54] SKIMMING APPARATUS FOR SWIMMING POOLS

[76] Inventor: Gaston Veillet, 85 St. Jean Baptise, Cap de la Madeleine, Quebec, Canada, G8T 6T6

[21] Appl. No.: 711,882

[22] Filed: Sep. 12, 1996

[51] Int. Cl.[6] ..... E04H 4/16

[52] U.S. Cl. ..... 210/169; 210/232; 210/242.1; 210/249

[58] Field of Search ..... 210/169, 232, 210/242.1, 249, 409, 456; 4/490, 496

[56] References Cited

U.S. PATENT DOCUMENTS

| | | | |
|---|---|---|---|
| 3,152,076 | 10/1964 | Kreutzer | 210/169 |
| 3,244,284 | 4/1966 | Shaffer | 210/169 |
| 4,089,074 | 5/1978 | Sermons | 210/169 |
| 4,734,189 | 3/1988 | Page, Jr. | 210/169 |
| 5,277,801 | 1/1994 | Lundquist | 210/169 |
| 5,350,508 | 9/1994 | Van der Watt | 210/169 |
| 5,454,940 | 10/1995 | Lakotish | 210/169 |

*Primary Examiner*—Neil McCarthy
*Assistant Examiner*—Theodore M. Green
*Attorney, Agent, or Firm*—Swabey Ogilvy Renault

[57] ABSTRACT

A skimming apparatus for a swimming pool that includes a ladder, the skimming apparatus is provided with a bracket to be mounted to a side rail of the ladder, the bracket having an offset arm and the skimming apparatus having a beam with a pivot rod pivotally mounted to the end of the offset arm so that when the skimming apparatus is deployed the beam will be blocked by the side rail of the ladder. The skimming apparatus has a pair of floats one on each end of the beam and a net is attached to the beam and the floats forming a pocket through which the water pushed by the current will pass through.

6 Claims, 2 Drawing Sheets

SKIMMING APPARATUS FOR SWIMMING POOLS

BACKGROUND OF THE INVENTION

1. Field of the Invention

The present invention relates to a swimming apparatus for a swimming pool, and particularly to an improved floating device that can be moved between an inoperative position adjacent a pool wall and an operative position at right angles to the pool wall.

2. Description of the Prior Art

I have described a pool skimming apparatus in my U.S. patent application Ser. No. 08/564,578 filed Nov. 29, 1995. Such skimming apparatuss or pool cleaners, are utilized for removing debris from the surface of the water in swimming pools. My earlier patent application describes an apparatus that uses a net for collecting the debris, while other patents such as U.S. Pat. No. 4,879,028 Gibson, Nov. 7, 1989 describes a diverter boom for diverting the debris from the surface to a skimmer inlet in the wall of the pool. Both of these devices extend at right angles to the pool wall and rely on the fact that there is a water current induced in every pool by the circulating pump associated with the filtering system.

U.S. Pat. No. 4,734,189 Page, Jr. Mar. 29, 1988, also describes a diverting boom for skimming the surface of a swimming pool, and this boom can be pivoted from an inoperative position adjacent the pool wall to an operative position at an angle to the wall. Both the Page, Jr. patent and my own patent application describe skimmer devices that must be mounted by means of a pivot bracket to the wall of the pool. This has been found to be impractical in many pools, since it is necessary to bolt or otherwise mount the pivot bracket to the wall of the pool. In the case of below ground pools it will be difficult to retrofit such a device to the pool wall. Such devices would have to be installed at the time of initially installing the pool.

SUMMARY OF THE INVENTION

It is an aim of the present invention to provide a swimming pool skimmer that can be pivoted between an operative position and an inoperative position against the wall of the pool but without the necessity of using a mounting bracket bolted to the wall.

It is a further aim of the present invention to provide a mounting bracket for a pivoting skimmer apparatus that can be mounted to an existing accessory such as the side rail of a swimming pool ladder.

A construction in accordance with the present invention comprises a kit for skimming debris on the surface of a swimming pool wherein the pool includes a pool wall and an accessory having a substantially vertical support member mounted to the pool with the substantially vertical member spaced from but adjacent the pool wall. The kit includes a first bracket having a clamp for fixedly engaging the vertical member, and the bracket includes an arm extending towards the pool wall and offset in the upstream direction of a current in the pool and including an end portion. The kit further includes a beam and at least a pair of floats on the beam to maintain the beam at the surface of the pool. The beam and the first bracket are adapted to define a swivel joint at the end portion of the offset arm such that when assembled in a pool the beam may pivot from a position adjacent to the pool wall and a position abutting the vertical member downstream of the offset arm, substantially at right angle to the pool wall, when a current is induced in the pool and a skimming means, is mounted to the beam for skimming the surface of the water when the beam is deployed.

In a more specific embodiment of the present invention the end portion of the arm includes a bore and the beam includes a pivot member adapted to be journaled in the bore of the end portion of the offset arm so as to provide pivoting movement to the beam in a horizontal plane on the surface of the pool. More specifically the pivot member is free to move vertically in the bore so as to allow for the vertical adjustment of the beam.

In a more specific embodiment the skimming means is a net supported on the beam.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
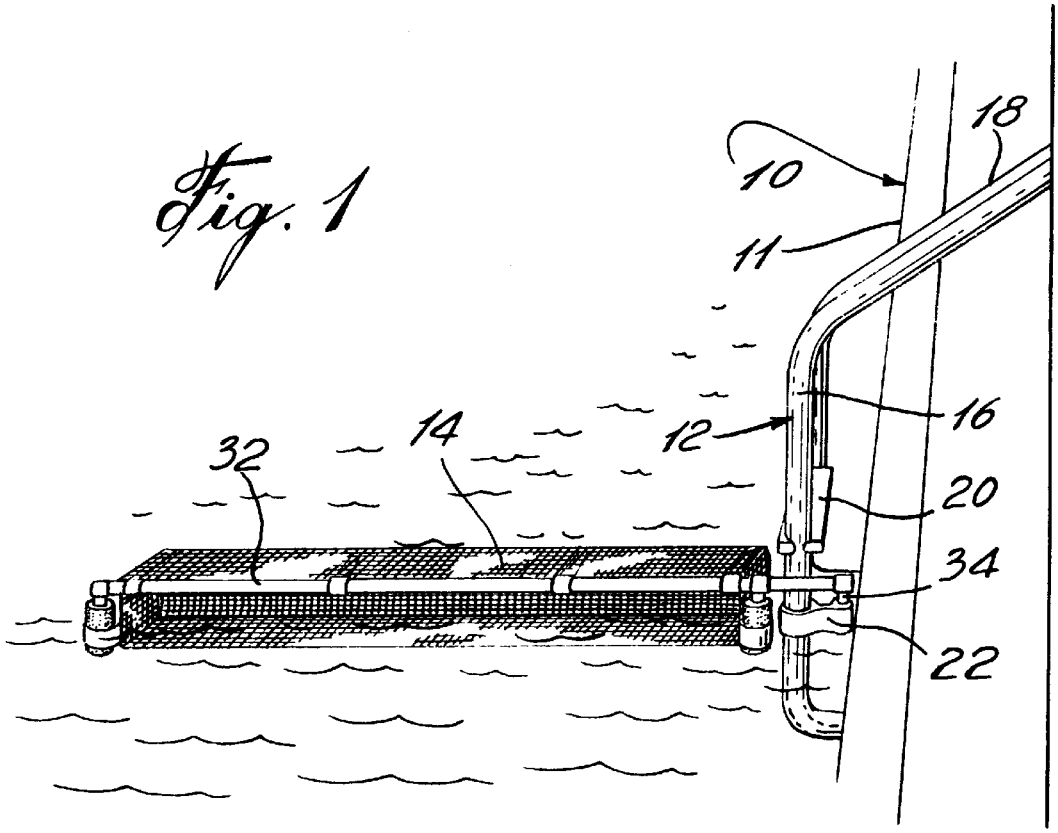
FIG. 1 is a perspective view of an embodiment of the present invention in an operative position.

Referring first to FIG. 1, a typical pool 10 is illustrated having a wall 11. A pool ladder 12 is hung on the side wall 11. A floating skimming apparatus 14 is illustrated as deployed on the surface of the pool.

The ladder 12 may be any conventional ladder supplied with the swimming pool or purchased after the installation of the pool and secured to the wall of the pool or the deck surrounding the pool.

In the embodiment shown in FIG. 1, the ladder 12 includes side rails 16 and 18 and runner 20. The side rails 16 and 18 have a vertical component, the importance of which will be described later.

Figure 4:
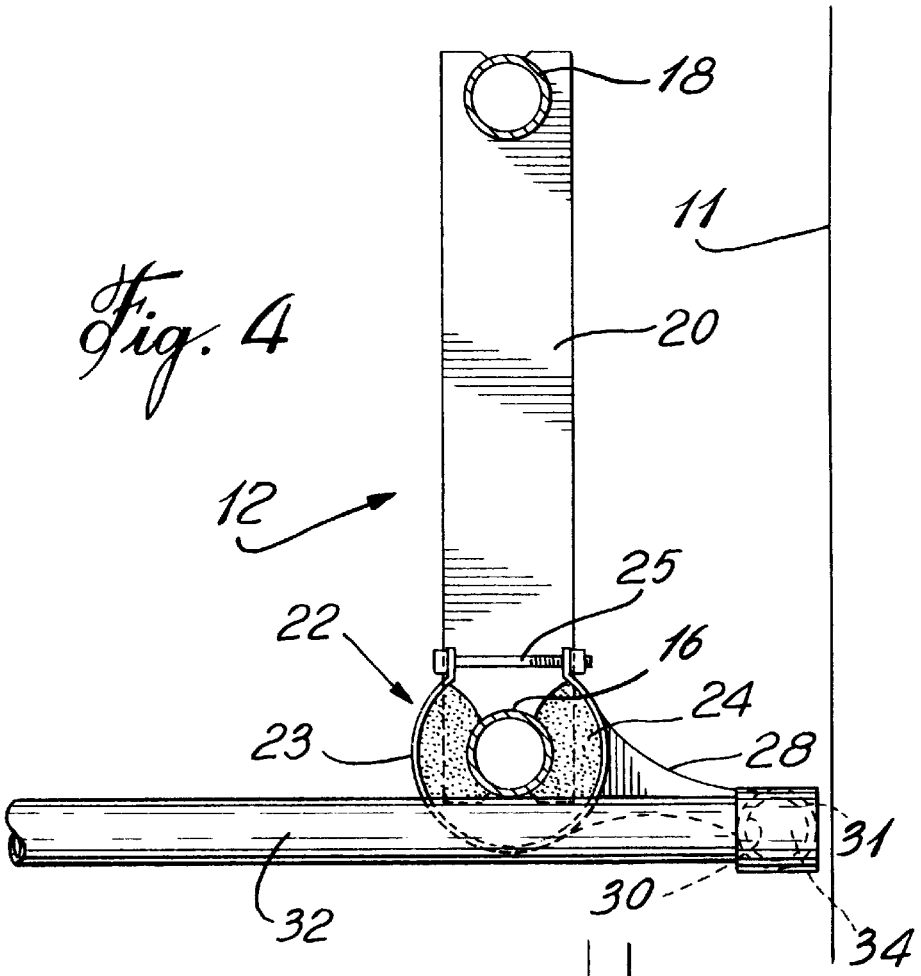
FIG. 4 is a fragmentary horizontal cross-section.
Figure 3:
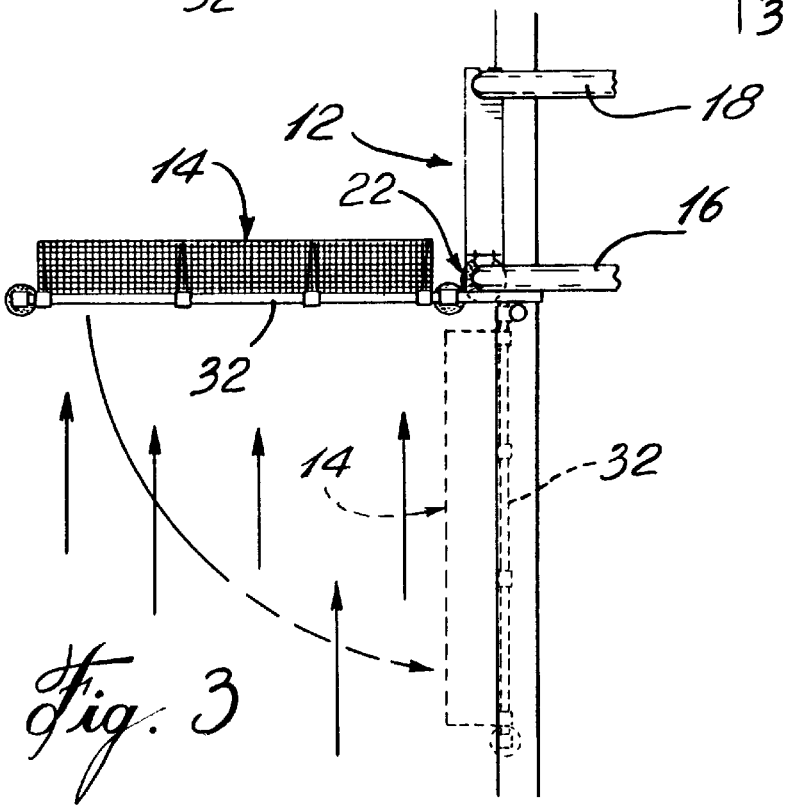
FIG. 3 is a top plan view of the embodiment as shown in FIG. 1.

A mounting bracket 22 is shown in FIG. 4 which includes a hoop or clamp portion 23 surrounding the side rail 16 of the ladder 12. The clamp 23 includes a series of bolts 25 passing through openings 26 at the end of the clamp arm. A resilient annular pillow 24 is located on the side rail 16. This resilient pillow can be made of rubber or of a firm foam plastic. Depending on the actual shape of the side rail 16, different pillows can be custom fitted thereto without changing the configuration of the clamp 23. An arm 28 extends at an angle from the clamp 23 and is provided with a vertical bore 30 at the swivel seat 31 of the arm 28. As will be described later, the swivel seat 31 is located adjacent the wall 11 of the swimming pool 10 and is offset from the center of the clamp 23.

The skimming apparatus 14 includes a beam 32 to which a skimming net 50 is mounted. The beam 32 mounts a pivot rod 34 at one end thereof. The pivot rod 34 is meant to be journaled in the bore 30 at the swivel seat 31 of the arm 28. When the skimming apparatus 14 is deployed, the beam 32 which is held by means of the pivot rod 34 abuts against the side rail 16 of the ladder, thereby blocking the beam 32 from further movement beyond the substantially right angle deployment relative to the wall 11. The pivot rod 34 has a constant diameter so that it can move vertically in the bore 30, depending on the level of the beam 32.

Figure 2:
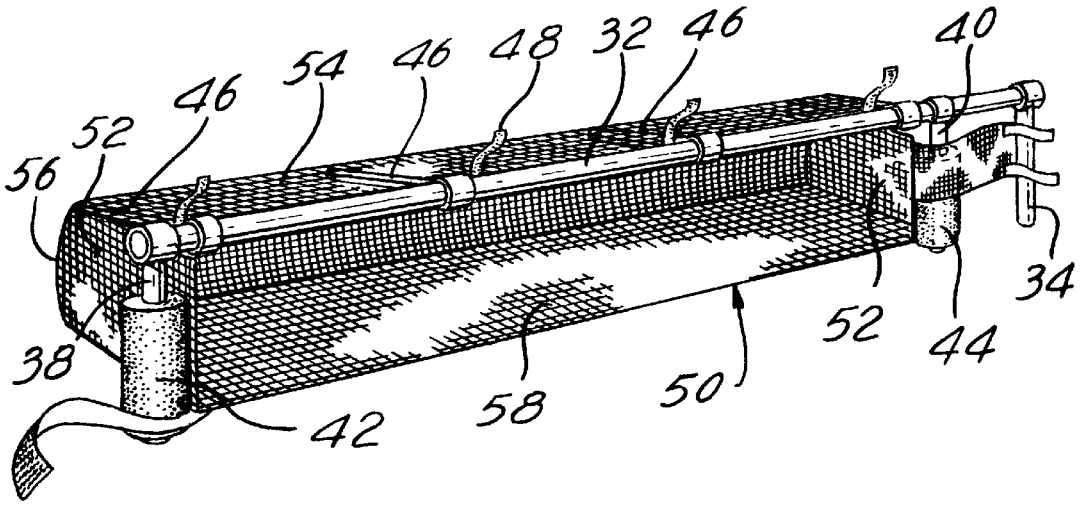
FIG. 2 is a perspective view of a detail of the present invention.

The beam 32 is provided with a pair of floats 42 and 44 near each end of the beam. The floats are mounted to rods 38 and 40 as shown in FIG. 2. Rods 38 and 40 are identical and each have a constant diameter portion as well as an annular socket portion. A set screw 39 is located in the annular portion in order to lock the rods 38 or 40 on the beam 32. As can be seen the beam 32 is in the form of a cylindrical tube.

Further support members 46 are mounted to the beam 32 between the members 38 and 40 and these support members 46 extend rearwardly and horizontally in order to support the top wall 54 of a net 50. The net 50 includes side walls 52, rear wall 56, and a bottom wall 58. The net 50 can be fixed to the tube 32 and the rod members 38 and 40 by means of Velcro tapes. All of the support members 38, 40, 46, as well as the pivot rod 34 can be identical and can be injection molded.

As can be seen, the skimming apparatus 14 can be floated so that the net 50, provided with a deep pocket, can be at the surface of the water with the water level somewhat in the middle of the pocket. This can be obtained by adjusting the float members 42 and 44 on the support rods 38 and 40.

In operation, the skimming apparatus 14 can be pivoted such that the beam 32 is against the wall 11 of the swimming pool, thus the skimming apparatus is in its stored position. As is well known, the water in a swimming pool is never stagnant, but is circulating by means of the filter pump outboard of the pool. The water will follow a somewhat circular current and it is necessary to mount the skimming apparatus 14 so that it is encountering the water moving with the current. The skimming apparatus 14 can be deployed by pivotally moving the skimming apparatus 14 or the beam 32 about its pivot axis in the bore 30 of the bracket 22. When the skimming apparatus 14 is deployed it is in the current in the swimming pool 10 but will be blocked by the side rail 16 which is downstream of the beam 32.

Thus, a kit is provided where there are no mounting plates to be mounted to the wall of the pool or elaborate mounting brackets on the deck outboard of the pool wall. It is merely necessary to mount the skimming apparatus kit to an existing side rail of a ladder for instance. Other accessories in the pool having similar element with a vertical component near the wall of the pool would also be useful in this context. The skimming apparatus could also be a diverting dam as shown in some of the prior art but with the novel mounting feature of the present invention.

I claim:

1. A skimming apparatus kit for skimming debris on the surface of a swimming pool wherein the swimming pool includes a pool wall and an accessory having a substantially vertical support member mounted to the pool with the vertical member spaced from but adjacent the pool wall, the kit includes a first bracket having a clamp for fixedly engaging the vertical member, the bracket further includes an arm extending towards the pool wall and having a swivel seat at the end thereof offset from the clamp in the upstream direction relative to the current in the pool; the kit further including a beam and at least a pair of floats mounted to the beam to maintain the beam at the surface of the pool, the beam including swivel means adapted to define a swivel joint at the swivel seat such that when assembled in a pool the beam may pivot from a position adjacent to the pool wall to a position abutting the vertical member downstream of the arm, substantially at right angle to the pool wall, when a current is induced in the pool, and a skimming means is mounted to the beam for skimming the surface of the water when the beam is deployed.

2. A kit as defined in claim 1, wherein the swivel seat is provided with a bore and the swivel means of the beam is provided with a pivot rod extending through the bore and journaled in the bore so as to provide pivoting movement to the beam in a horizontal plane and vertical sliding movement so that the skimming apparatus is maintained on the surface of the pool and wherein the beam will be blocked by the vertical member when deployed.

3. A kit as defined in claim 1, wherein the floats are provided on the beam for floating the beam and skimming means at the surface of the pool.

4. A kit as defined in claim 3, wherein the skimming means is in the form of a net attached to and supported on the beam.

5. A kit as defined in claim 4, wherein the net forms a pocket with top, bottom, and side walls for collecting debris on the surface of the water when the water is pushed through by the current of the swimming pool.

6. A kit as defined in claim 1, wherein the vertical member for the accessory is side rail of a pool ladder mounted to the pool.

* * * * *